United States Patent [19]

Aghnides

[11] Patent Number: 4,733,818

[45] Date of Patent: Mar. 29, 1988

[54] SHOWERHEAD WITH MEANS FOR SELECTING VARIOUS FORMS OF OUTPUT STREAMS

[76] Inventor: Elie P. Aghnides, 2 E. 61st St., New York, N.Y. 10021

[21] Appl. No.: 269,158

[22] Filed: Jun. 1, 1981

[51] Int. Cl.[4] ..... B05B 1/12; B05B 1/16

[52] U.S. Cl. ..... 239/428.5; 239/447; 239/553.3

[58] Field of Search ..... 239/428.5, 447, 443, 239/444, 446, 553, 553.3, 563, DIG. 18, 442, 436

[56] References Cited

U.S. PATENT DOCUMENTS 2,670,942 3/1954 Aghnides ..... 239/391

3,811,619 5/1974 Aghnides ..... 239/428.5

*Primary Examiner*—Andres Kashnikow

*Attorney, Agent, or Firm*—Hall, Myers & Rose

[57] ABSTRACT

The present invention is for a showerhead selectively operable to produce a plurality of different streams, enabling the user to select one form of large diameter stream, rich in bubbles, when the water pressure is high, and another large diameter rich stream full of bubbles when the water pressure is low. Furthermore, the user may select a spray instead of the bubbly stream. The invention is accomplished by having an upstream disc with chambers therein for directing the water downstreamwardly. In the path of the jets from said chambers there is a screened-disc which is rotatable selectively by the user and which has a number of openings therethrough. By bringing the correct opening below the jets, the user may select one of several different types of streams. One of the openings has two screens, one at the top and one at the bottom of the opening so that at low water pressures, there is abundant aeration which provides a rich outgoing stream of water. For a normal aerated showerhead, there is a hole with just one screen. Similarly, there is a third hole without any screen and which will produce a spray when that hole is located below the chambers. Similarly, the chambers may be duplicated around the upstream disc so that when the user selects a given form of stream, the type of hole that produces that stream will be receiving all of the water from all of the different chambers.

1 Claim, 7 Drawing Figures

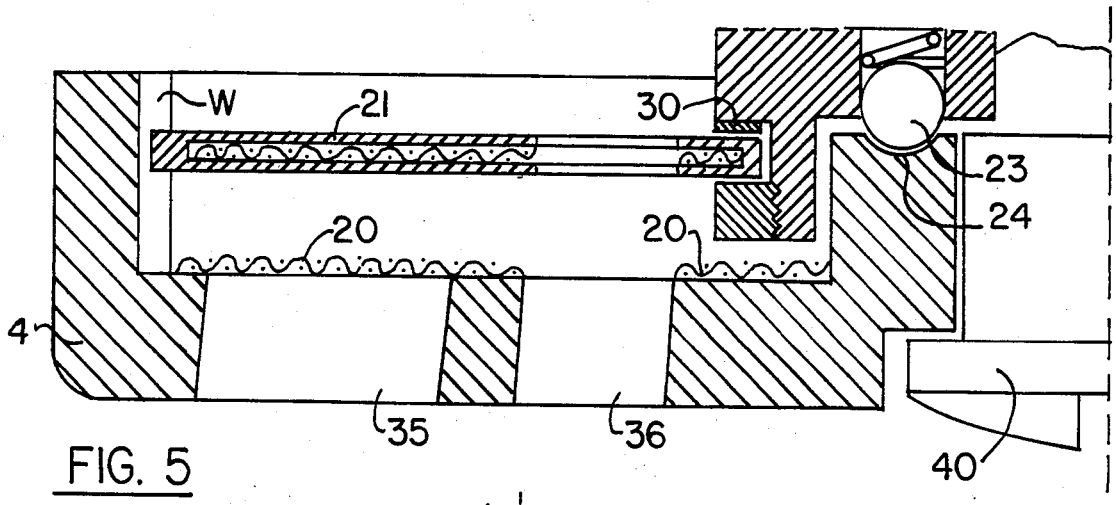
FIG. 5
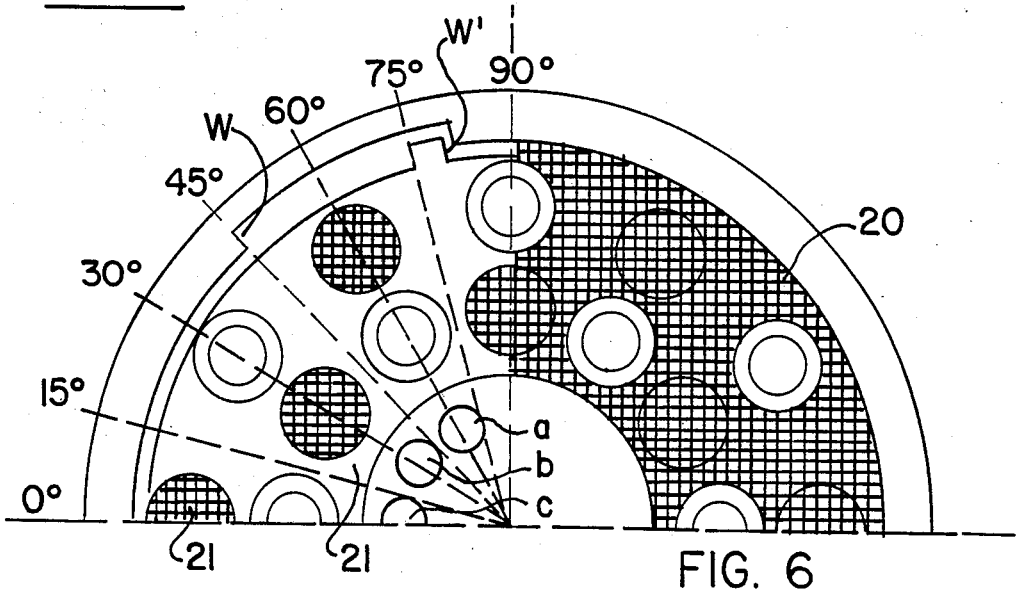
FIG. 6
FIG. 7
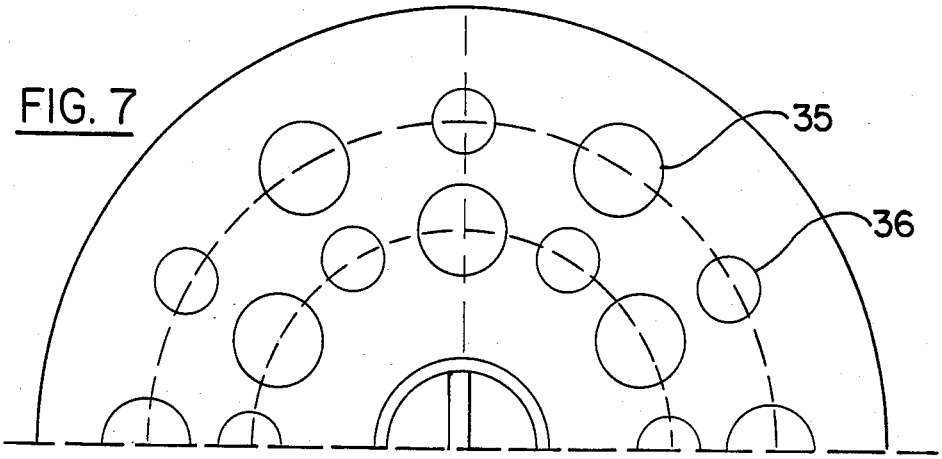

SHOWERHEAD WITH MEANS FOR SELECTING VARIOUS FORMS OF OUTPUT STREAMS

In my prior patent, for example, U.S. Pat. No. 2,670,942, entitled "Aerator" of Mar. 2, 1954, I describe a faucet attachment for producing either a coherent jet of aerated water or a spray. In the following three of my U.S. patents, the operator may select either a bubble stream or a bubble-free jet: U.S. Pat. No. 3,633,824 entitled "Spray-Producing Device In Which The Outputs Are Aerated", issued Jan. 11, 1972; U.S. Pat. No. 3,811,619 entitled "Spray-Producing Device", issued May 21, 1974; and U.S. Pat. No. 3,829,026 entitled "Spray-Producing Device", issued Aug. 13, 1974. The object of the present invention is to provide an improved showerhead in which the operator may select the type of stream which is best for his purpose, under the available water pressure.

The present invention is for a showerhead selectively operable to produce a plurality of different streams, enabling the user to select one form of large diameter stream, rich in bubbles, when the water pressure is high, and another less large diameter stream full of bubbles when the water pressure is low. Furthermore, the user may select a spray instead of the bubble stream.

SUMMARY OF THE INVENTION

The invention is accomplished by having an upstream disc with chambers therein for directing the water downstreamwardly. These chambers are of the general type shown in FIGS. 2 and 3 of my prior U.S. Pat. No. 2,998,929 entitled "Water Aerators", issued Sept. 5, 1961. In the path of the jets from said chambers there is a screened-disc which is rotatble selectively by the user and which has number of openings therethrough. By bringing the correct opening below the jets, the user may select one of several different types of streams. One of the openings has two screens, one at the top and one at the bottom of the opening so that at high water pressures, there is abundant aeration which provides a rich outgoing stream of water. For a normal aerated showerhead, there is a hole with just one screen. Similarly, there is a third hole without any screen and which will produce a spray when that hole is located below the chambers. Similarly, the chambers may be duplicated around the upstream disc so that when the user selects a given form of stream, the type of hole that produces that stream will be receiving all of the water from all of the different chambers.

IN THE DRAWINGS

FIG. 5 is a cross-sectional view of a modified form of the invention.

FIG. 6 illustrates the lower screened-discs of the construction of FIG. 5.

FIG. 7 is an illustration of the plan of the holes 35 and 36 in the lower screened-disc 4 of FIG. 5.

DETAILED DESCRIPTION OF THE DRAWINGS

While in my prior marketed showerheads the bubble streams were formed each by one jet and said jet traversed two screens, in my present invention one screen upstream a smaller orifice, or two screens, or a screenless opening are traversed by preferably a plurality of jets, so that bubble streams of different diameters and bubble-free jets in greater number than heretofore may be produced. Further, a greater number of bubbly streams may be produced than heretofore if the showerhead produces only bubble streams through single screens.

Figures 1, 2:
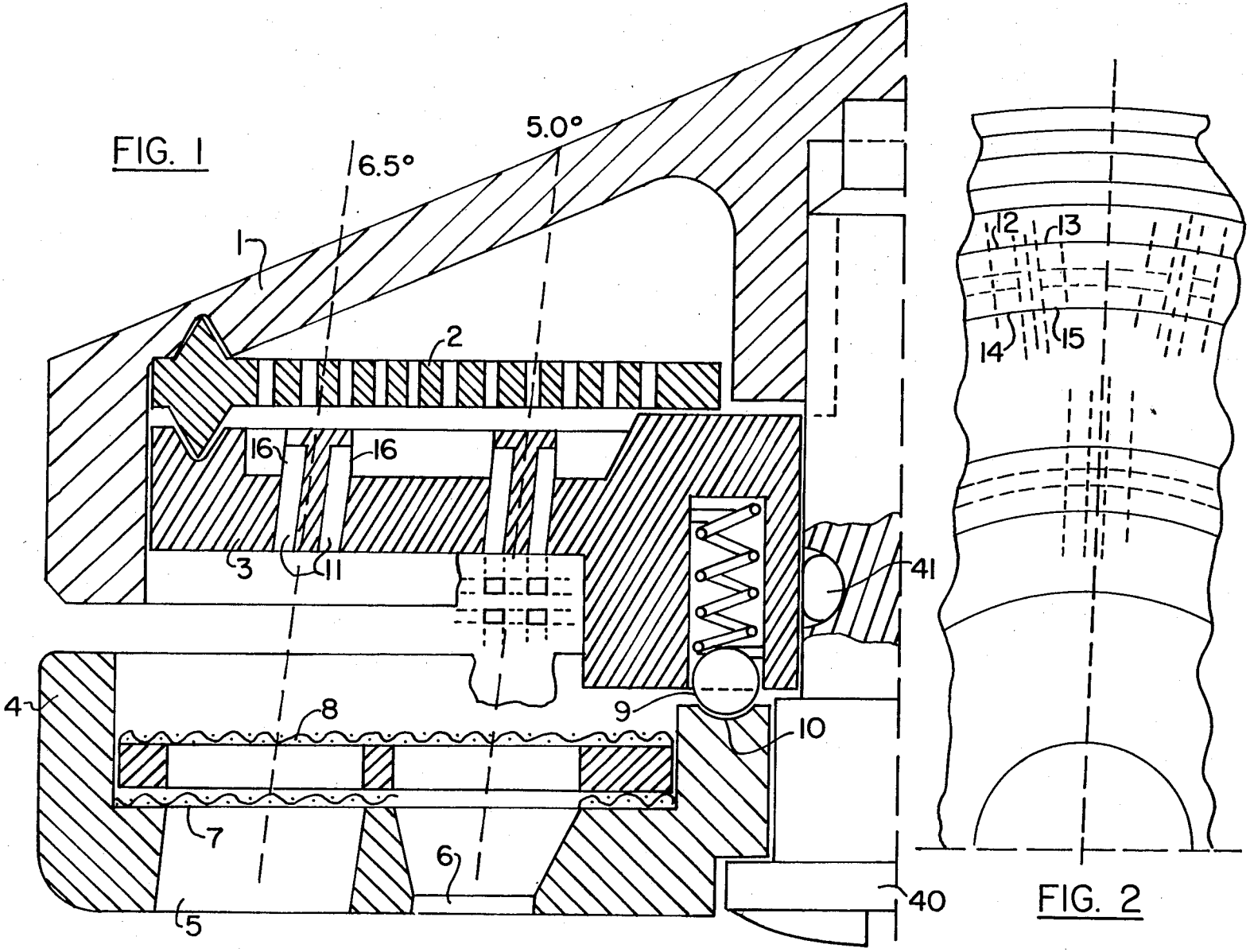
FIG. 1 is a cross-sectional view of one form of the invention.
FIG. 2 is a top-view of typical holes in the disc 3.

In FIG. 1 is shown a rubberlike perforated sieve 2 the periphery of which serves as a washer, 1 is a handshower, 3 is a disc producing jets of high velocity, 4 is a rotatable casing, having openings 5 and 6, of which opening 5 is topped by two spaced screens 7 and 8, whereas opening 6 is topped by one screen 8. There is also a totally unscreened opening 17 shown in FIG. 3 by 17. Pin 40 holds the parts assembled in position and rubber ring 41 prevents leakage.

Between the casing 4 and disc 3 there is a springed ball 9 resting in the cavity 10. The opening 5 has a diameter of 6.75 mm. throughout its height whereas the opening 6 has 4.5 mm. or 5.0 mm. diameter at the outlet end and 6.75 mm. diameter at the inlet end. The disc 3 has two rows of six quadruplets of holes 11 each and one of said quadruplets is shown in FIG. 2 by dotted lines as 12, 13, 14 and 15. The cross-section of each of the holes 11 is 1.0×1.0 mm. and the windows feeding with water said holes 11 was each 1.0 mm. wide, 1.0 mm. high.

The rotatable casing 4 can be stopped either in the position in which the jets from 12 quadruplets traverse the 12 opening 5 producing 12 bubbly streams of 6.75 mm. diameter each, or in the position in which said quadruplets of jets traverse the openings 6 producing 12 bubbly streams of 4.5 mm. diameter each. The casing 4 may be stopped in a third position in which said quadruplets of jets traverse the said 12 totally unscreened openings 17 shown in FIG. 3, of 5 mm. diameter each producing 48 bubble-free jets.

It will be noted that, in FIG. 1, the openings 6 are of 6.75 mm. diameter at their upstream ends and gradually narrow down to 4.5 mm. diameter, so that the sharp jets from orifices 11, broken up by screen 8 gradually coalesce and discharge as a coherent bubble stream of 4.5 mm. or 5.0 mm. diameter.

Figures 3, 4:
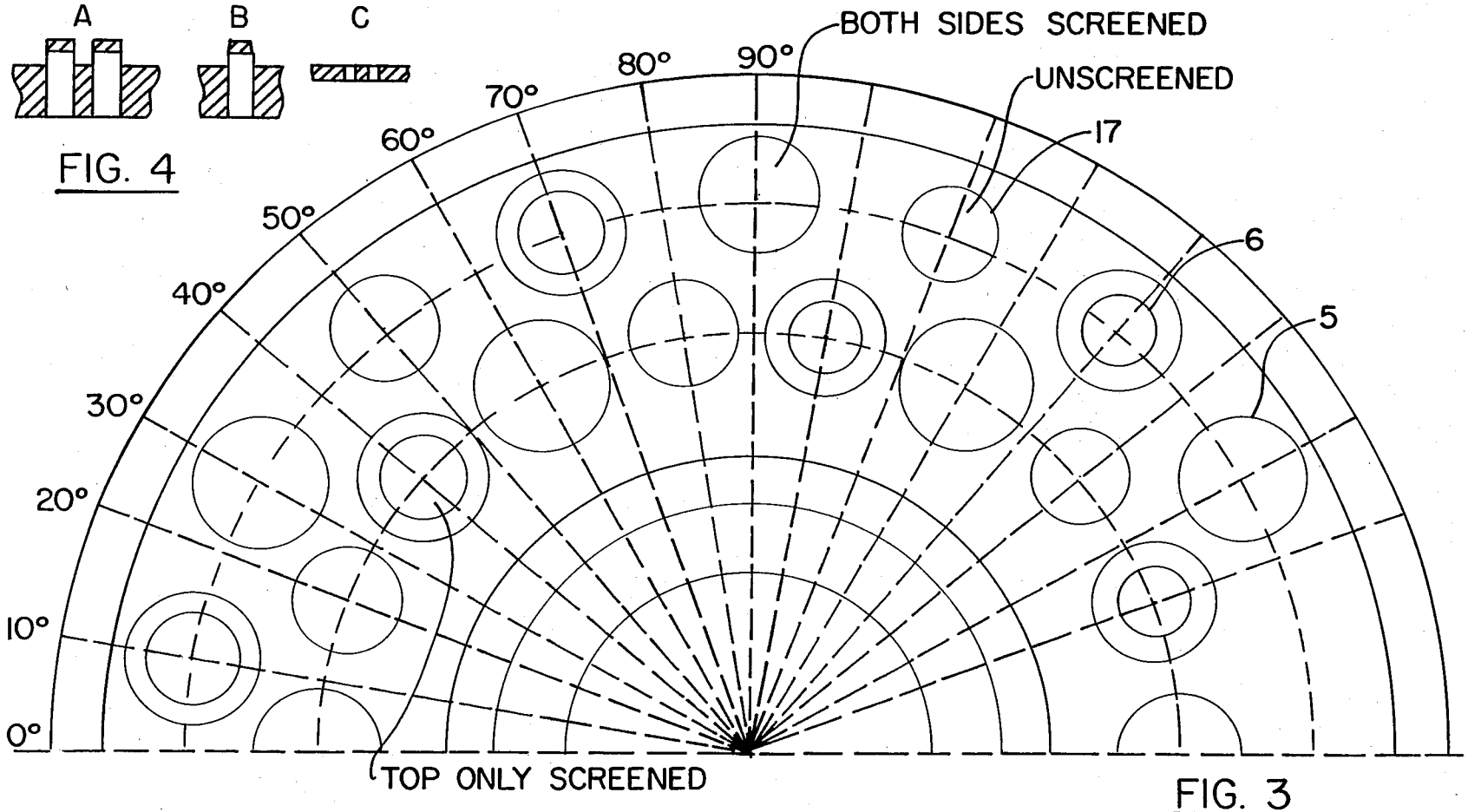
FIG. 3 illustrates a set of typical holes in the downstream screened-disc or casing 4, wherein the screens are not shown.
FIG. 4 illustrates typical chambers that may be used in the disc 3.

The bubble streams produced by the high velocity quadruplets of jets from holes 11 traversing only one screen, proved to have more vigor, velocity and bubbles than the bbble stream produced heretofore by one jet delivered by holes of the type shown in FIG. 4 by A or B or C traversing a set of two screens.

The showerheads of my said prior patents made and sold in Europe and U.S.A. comprised discs having one of the two holes shown by A in FIG. 4. In these showerheads two screens in the path of single jets were used. The said prior showerheads had 16 holes of 1.25×1.25 mm. cross-section topped each by two entrance openings of 1.0×0.95 mm. each.

My European showerheads produced alternately 16 bubbly streams of 4.5 mm. or 5.5 mm. diameter each or 16 bubble-free jets, at will. The said prior showerheads are not very effective when they are required by the present U.S. laws not to deliver more than three gallons of water per minute under a back pressure of 80 lbs. Thus, while the intent of said laws is to save water, the inapplicability of my said showerheads for operation under such low water pressure, results in the use of the conventional showerheads which waste half of the showering water in splash. The bubbly streams end splash, put to use all the water drawn.

A comparison between my prior foam-producing showerheads and the present one showed that the prior one had a rate of flow of 16 liters per minute at 1.5 atmospheres whereas my present showerhead has a rate of flow of 18 liters per minute under same 1.5 atmospheres. Yet, when the respective valves controlling the flow of the prior and present showerheads of mine were so open as to allow both types to deliver the same amount of water per minute, it was found that while my prior showerhead could not operate satisfactorily at the low flow rates required by the present U.S. rules, the new showerhead was found to be fully satisfactory, inasmuch as the bubbly streams it produced were fully bubble-laden and vigorous, producing, moreover, at average rates of water flow, some 30% more foam. Thus, the new showerhead will help save a great deal of water, producing a vast amount of foam, that is a multiple volume than plain splashless water flowing over showeree's body.

It is understood that the functional parts of the hand-shower just described may be embodied in a head shower and the number as well as the rows of the said holes and openings may be decreased or increased if larger rate of flow is required. Further, such showerheads may comprise, in addition to the three different types of openings, a fourth type with larger cross-sections and be equipped if needed with three screens, for the production of bubbly streams of larger cross-sections, for use, i.e., in sports clubs.

FIGS. 5, 6 and 7 represent a showerhead producing four different types of streams by having the downstream screen 20 permanently attached to the casing and the upstream screen 21 rotatable, such rotation being effected automatically during the rotation of the casing. As casing 4 is being rotated 30°, ball 23, at first in depression a, said casing will fall next in depression b and then in depression c. The half-tight rubber ring 30 prevents the accidental rotation of the framed screen 21. Screen 21 will be carried along only by the walls W and W' of the casing when said casing is rotating.

In FIGS. 5, 6 and 7 holes 35 have a diameter of 6.75 mm. and holes 36 a diameter of 5.0 mm. Thus, the casing starting to rotate at stop point 0° will reach the next stop-point after a rotation of 30° and when it is further rotated by 30°, it will reach the last stop-point after a total rotation of 60°. At rotation from 0° to 30°, the casing will not rotate the framed screen 21 but at rotation from 30° to 60°, the casing will rotate by 30° the said framed screen 21. At stop-point 0°, 12 bubbly streams of 6.75 mm. diameter will be produced with the water flowing through two screens 20 and 21. After 30° rotation, the 12 quadruplets of 4 jets each will traverse openings 35 of 6.75 mm. diameter having one screen 20. When casing 4 is further rotated 30°, to make a total rotation of 60°, each quadruplet of jets will traverse a single screened orifice 36 of 5.0 mm. diameter. Now, when casing is rotated in the opposed direction by 30°, the 12 quadruplets of jets will traverse the 12 unscreened openings 36 producing 48 bubble-free jets. At the last turn in the opposite direction—from 30° to 0°—again the 12 bubbly streams of 6.75 mm. diameter will be produced.

I claim:

1. In a showerhead:

showerhead means having a centerline and a row of a given number of orifice means, each orifice means defining at least one orifice for directing at least one streamlet downstreamwardly, said row being a circle having its center located on said centerline, said showerhead means also having a second circular row concentric with the first row and also having said given number of orifice means, the orifice means in each row being equally angularly spaced from each other along the row, and the orifice means in one of said rows being staggered angularly about said centerline from the orifice means in the other of said rows, and rotatable means downstream of said showerhead means and rotatable about said centerline into at least three angular positions, said rotatable means including screen means for mixing the water of said streamlets with air only once while the streamlets are passing the rotatable means, when said rotatable means is in one of its angular positions, said rotatable means including screen means for mixing the water of said streamlets with air first and second times while the streamlets are passing the rotatable means, when said rotatable means is in another one of said angular positions of said rotatable means, said rotatable means including means for allowing the streamlets to pass said rotatable means in the form of a spray without any substantial mixing when said rotatable means is in still another one of its angular positions, said rotatable means including two concentric rows of holes through which said streamlets pass, said rotatable means also including two separate screen means one above the other, said rotatable means including a lost-motion connection between said two separate screen means and including means for providing four different types of output streams by selectively rotating said rotatable means, said rotatable means being selectively operable to provide two types of streams while said connection is in its lost-motion mode, to provide a third type of stream when the lost-motion connection is operated in one direction, and to provide a fourth type of stream when said connection partially traverses the lost-motion mode after providing the third type of stream.

* * * * *